US008321978B1

(12) United States Patent
Fulton

(10) Patent No.: US 8,321,978 B1
(45) Date of Patent: Dec. 4, 2012

(54) PILLOW WITH CONCEALED PLAY BODY

(76) Inventor: Mahalie A. Fulton, Sarasota, FL (US)

( * ) Notice: Subject to any disclaimer, the term of this patent is extended or adjusted under 35 U.S.C. 154(b) by 0 days.

(21) Appl. No.: 13/527,930

(22) Filed: Jun. 20, 2012

(51) Int. Cl.
*A47G 9/00* (2006.01)

(52) U.S. Cl. ..... 5/639; 5/636

(58) Field of Classification Search ..... 5/639, 636, 5/630; 297/461–462 D1
See application file for complete search history.

(56) References Cited

U.S. PATENT DOCUMENTS

| | | | | |
|---|---|---|---|---|
| 4,563,159 | A * | 1/1986 | Hills et al. | 446/74 |
| 4,734,075 | A | 3/1988 | Park | |
| 4,763,369 | A | 8/1988 | Spector | |
| 4,824,509 | A * | 4/1989 | Tonoki et al. | 156/285 |
| 4,889,512 | A | 12/1989 | Burnett et al. | |
| 5,090,938 | A | 2/1992 | Reynolds | |
| 5,115,528 | A | 5/1992 | Lamle | |
| 5,118,318 | A | 6/1992 | Lorizio | |
| 5,138,728 | A | 8/1992 | Aston | |
| 5,328,399 | A | 7/1994 | Reynolds | |
| D358,054 | S | 5/1995 | Burdorf et al. | |
| 5,421,045 | A | 6/1995 | Bowen | |
| D364,985 | S | 12/1995 | Burdorf et al. | |
| 5,509,157 | A | 4/1996 | Story | |
| 5,778,468 | A | 7/1998 | Saarela et al. | |
| 6,038,719 | A * | 3/2000 | Castagna | 5/636 |
| 6,434,769 | B1 | 8/2002 | Koenig | |
| D476,184 | S | 6/2003 | Hall | |
| 6,668,400 | B1 | 12/2003 | Nichols et al. | |
| 6,755,712 | B2 | 6/2004 | Morris | |
| D504,269 | S | 4/2005 | Faircloth | |
| 7,089,617 | B1 | 8/2006 | Lauro | |
| 7,461,421 | B1 * | 12/2008 | Faircloth et al. | 5/639 |
| 7,722,357 | B2 | 5/2010 | Payette-Hebert et al. | |
| 7,730,564 | B2 * | 6/2010 | Moore | 5/639 |
| 2004/0199998 | A1 | 10/2004 | Shinner | |
| 2008/0182478 | A1 | 7/2008 | Smoot et al. | |
| 2010/0197190 | A1 | 8/2010 | Lloyd | |

OTHER PUBLICATIONS

Happy Nappers, www.happynapper.com.

* cited by examiner

*Primary Examiner* — Fredrick Conley
(74) *Attorney, Agent, or Firm* — Charles J. Prescott

(57) ABSTRACT

A child's stuffed pillow and a play item concealable within a pocket in the pillow. Two cushioning members, each including a cushioning medium and having a flexible fabric covering thereover, are attached together as by sewing in a side-by-side arrangement around common perimeter edges of inner covering panels of the coverings. A pocket is formed between the inner covering panels into which a play item is concealable within the pocket. A tether is connected between the bottom of the pocket and the neck of the play item to hold the play item in close proximity to the pocket during play wherein the child may grasp the play item like a handle of the pillow.

3 Claims, 9 Drawing Sheets

PILLOW WITH CONCEALED PLAY BODY

CROSS-REFERENCE TO RELATED APPLICATIONS

Not applicable

STATEMENT REGARDING FEDERALLY SPONSORED RESEARCH OR DEVELOPMENT

Not applicable

INCORPORATION-BY-REFERENCE OF MATERIAL SUBMITTED ON A COMPACT DISC

Not applicable

BACKGROUND OF THE INVENTION

1. Field of the Invention

This invention relates generally to bedding articles with hidden pockets for concealing an article and more particularly to a combination child's pocketed pillow and a hand graspable play item concealable within a pocket formed into the perimeter of the pillow, the play item, while remaining tethered, is removable from the pocket for play making the pillow "doll like" and then reconcealable within the pocket.

2. Description of Related Art

Pillows are well known to provide young children with comfort, convenience, a place atop which to sleep and a source of comfort and play. U.S. Pat. No. 4,734,075 to Park discloses a plush toy doll capable of manipulation into a plurality of forms. Spector teaches a dual-function transformable pillow that functions as a head rest and transforms into a figurative humanoid or animal-like form to serve as a plaything in U.S. Pat. No. 4,763,369. A combination toy including a decorative pillow and a soft sculptural human figure doll is taught by Burnett et al. in U.S. Pat. No. 4,889,512.

In U.S. Pat. No. 5,090,938, Reynolds teaches an object capable of having its shape altered having a first cloth-like material formed in a first shape, an aperture formed in the first material so that an internal hollow of the first shape can be accessed and a second pliable material positioned within the internal hollow and formed to assume a second predetermined shape.

Lamle discloses a pillow transformable into an animal character or toy in U.S. Pat. No. 5,115,528. A security object system comprised of a combined pillowcase and doll carrier wherein the pillowcase includes a family unit depiction and removable pockets provide carrying means for removable dolls related to the family unit is taught by Lorizio in U.S. Pat. No. 5,118,318.

An interior container insert for a pillow, cushion or stuffed toy which consists of an insert bag with an anchor which can be inserted into and anchored to the above forms is taught by Aston in U.S. Pat. No. 5,138,728. Reynolds discloses toy objects that can be altered to assume different shapes associated with the same activity in U.S. Pat. No. 5,328,399.

Burdorf et al. teach ornamental designs for convertible cushions in U.S. Patent Des. 358,054 and Des. 364,985. A soft sculpture convertible to a blanket with pillow having a hollow body portion including an opening for receiving and storing a blanket therein is taught by Bowen in U.S. Pat. No. 5,421,045.

U.S. Pat. No. 5,509,157 to Story discloses pillow cases utilized for both decorative and functional sleeping purposes. The pillow case is adapted to receive caricature animal and other caricature character appendages at the pillow case corners. Saarela et al. teach a combination pillow, tote and toy consisting of a pillow, a fabric handle allowing the pillow to be carried, a fabric doll and a pocket which provides a place to put books or toys in U.S. Pat. No. 5,778,468.

A dual purpose plush toy used as both a sleep enhancer toy and headrest pillow is taught by Koening in U.S. Pat. No. 6,434,769. Hall teaches the ornamental design for a gift pillow in U.S. Design Patent D476,184. U.S. Pat. No. 6,668,400 to Nichols et al. discloses an article of bedding with a hidden pocket for storing an item.

Morris discloses a soft and pliable doll having a self-contained closeable storage compartment within the body of the doll for accessories used therewith in U.S. Pat. No. 6,755,712. The ornamental design for a pillow with a cavity is taught by Faircloth in U.S. Design Patent D504,269.

U.S. Pat. No. 7,089,617 to Lauro teaches a pillowcase alone and in combination with a unique pillow design which provides an interior pocket open at an outer margin thereof for receiving and protectively storing small articles. A play pillow with hiding space is taught by Faircloth et al. in U.S. Pat. No. 7,461,421.

An educational pillow case having room for casing a pillow, an exterior surface having a shape of a stuffed toy, and a plurality of pockets and detachable pieces which include messages, objectives, incentives, rewards or a combination thereof is taught by Payette-Hebert et al. in U.S. Pat. No. 7,722,357. Shinner teaches a convertible blanket comprising a blanket and a pocket into which the blanket can be stowed to create a pillow or cushion in U.S. Patent Application Publication 2004/0199998.

An apparatus for a pillow that converts into a soft toy figure is disclosed by Smoot et al. in U.S. Patent Application Publication 2008/0182478. In U.S. Patent Application Publication 2010/0197190, Lloyd teaches an interchangeable plush toy and storage assembly. In some embodiments, the assembly comprises a pillow which includes a storage component.

The present disclosure provides a uniquely configured combination pillow which functions decoratively as a head, and play item such as a small miniature doll body which is concealable within a pocket formed between two connected together cushioning members so that the play item may be withdrawn from the pocket by the child, grasped, and played with while being maintained in tight proximity to the pocket and the opening from which the play item has been withdrawn, a tether acting to maintain close communication between the pillow and the play item.

The foregoing examples of the related art and limitations related therewith are intended to be illustrative and not exclusive. Other limitations of the related art will become apparent to those skilled in the art upon a reading of the specification and a study of the drawings.

BRIEF SUMMARY OF THE INVENTION

This disclosure is directed to a child's pocketed pillow in combination with a play item withdrawable from within a pocket in the pillow. Two cushioning members, each including a cushioning medium and having a flexible fabric covering thereover, are attached together as by sewing in a side-by-side arrangement around common perimeter edges of the coverings. An opening is formed into the perimeter between an unattached portion of the coverings extending inwardly between the coverings to form a pocket. A play item such as a stuffed headless doll body sized to be frictionally yet releasably situated in the pocket through the opening is concealable within the pocket. An elongated preferably non-elastic tether is connected at one end thereof to a bottom of the pocket, another end of the tether being connected to the play item and arranged to hold the play item in tight, close proximity to and just outside of the pocket during play, giving the appearance of a doll. An openable closure may extend along a length of the perimeter of each of the covers sized and arranged for removal and replacement of the cushioning members for cover laundering.

The following embodiments and aspects thereof are described and illustrated in conjunction with systems, tools and methods which are meant to be exemplary and illustrative and not limiting in scope. In various embodiments one or more of the above-described problems have been reduced or eliminated while other embodiments are directed to other improvements. In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

Figure 1:
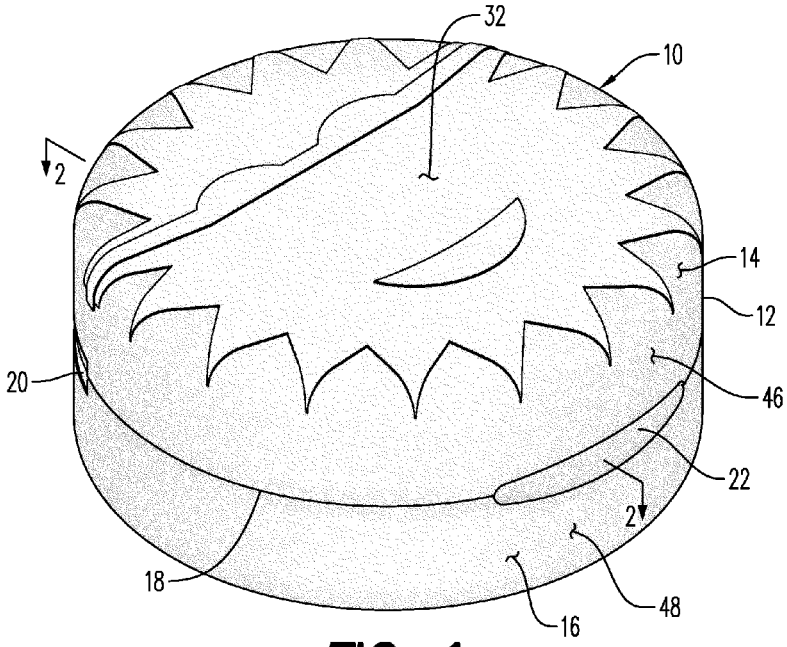
FIG. 1 is a perspective of one embodiment of the invention.

Exemplary embodiments are illustrated in reference figures of the drawings. It is intended that the embodiments and figures disclosed herein are to be considered to be illustrative rather than limiting.

DETAILED DESCRIPTION OF THE INVENTION

Nomenclature

10. combination pillow toy
12. pillow
14. cushioning member
16. cushioning member
18. perimeter seam
20. dual zipper
22. pocket opening
24. pocket
26. stuffed play item
26*a*. neck
28. flexible tether
30. attachment
32. decorative design
34. fabric strip
36. zipper
38. zipper
40. inner covering panels
42. foam cushioning medium
44. foam cushioning medium
46. fabric covering
48. fabric covering
50. pillow with play item
52. pillow
54. cushioning member
56. cushioning member
58. perimeter seam
60. pocket opening
62. stuffed play item
62*a*. neck
64. pocket
66. flexible tether
68. attachment
70. cushioning member
72. cushioning member
74. inner covering panels
76. loose cushioning medium
78. foam cushioning medium
80. fabric covering
82. fabric covering
84. decorative design
90. pillow
92. stuffed play item
92*a*. neck
94. flexible tether
96. pocket Referring now to the drawings and particularly to FIGS. 1 to 6A, the preferred embodiment of the invention is there shown generally at numeral 10. This combination pillow toy 10 includes a cushioned, compressible pillow 12 formed of two cushioning members 14 and 16, each of which include a flexible fabric covering 46 and 48, respectively. Each of the cushioning members 14 and 16 also include a cushioning medium 42 and 44, respectively, which, in this embodiment 10, are formed of a compressible closed cell foam material, preferably densified foam batting, 100% polyester fiber. A decorative design 32 may be applied to an outer surface of one or both of the coverings 54 and 56, preferably having an appearance of a decorative face.

Figure 2:
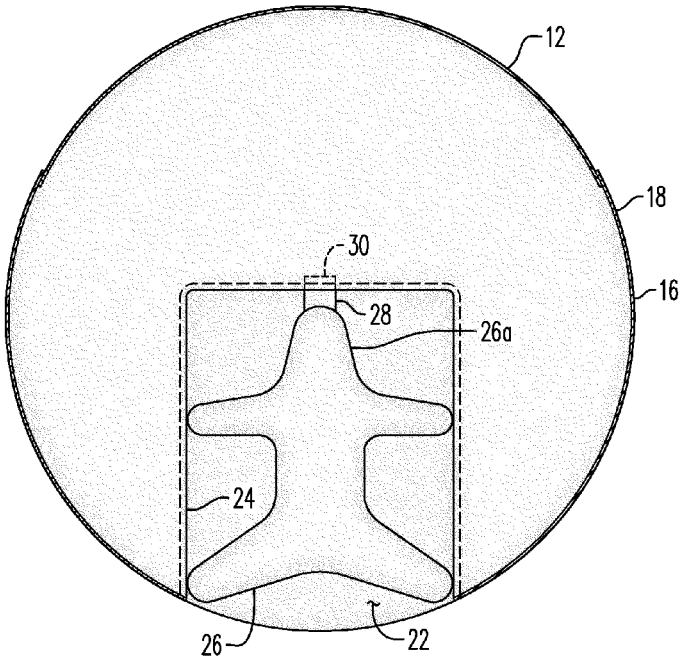
FIG. 2 is a section view in the direction of arrows 2-2 in FIG. 1.
Figure 3:
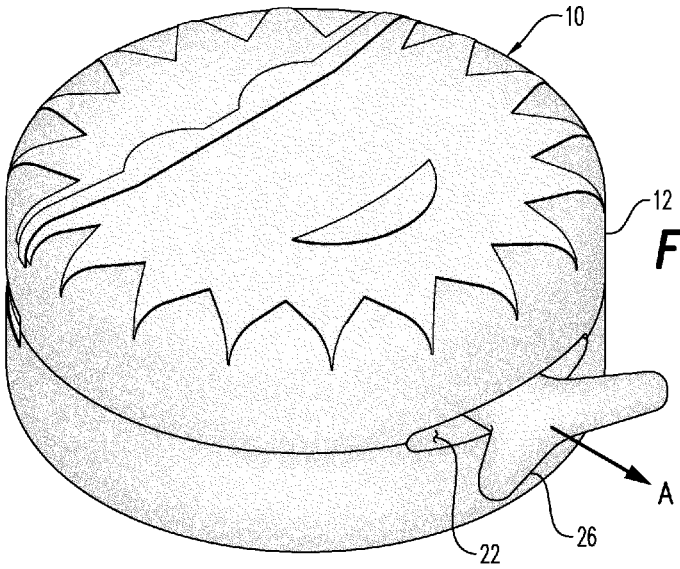
FIG. 3 is a perspective view of FIG. 1 showing the withdrawal of the play item from the pocket through the opening in the perimeter of the pillow 10.
Figure 5:
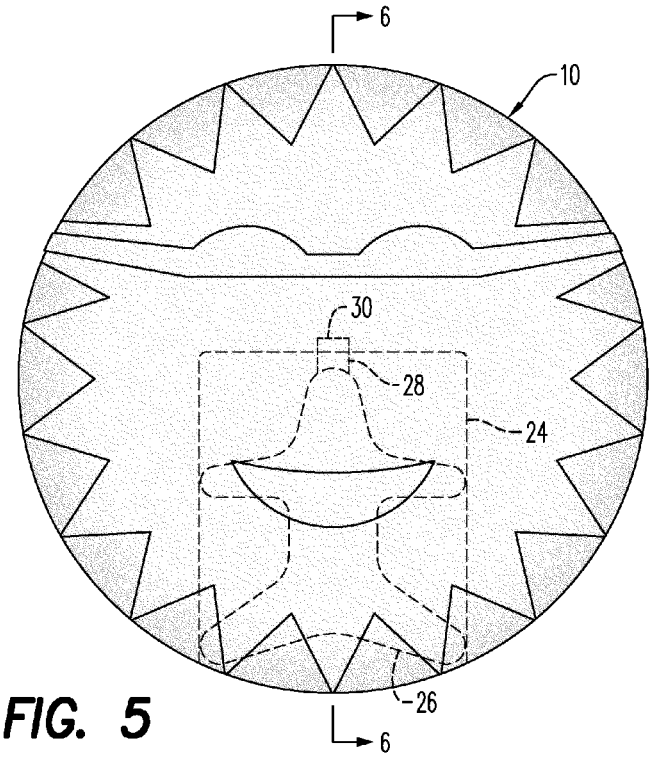
FIG. 5 is a top plan view of FIG. 1.
Figure 6:
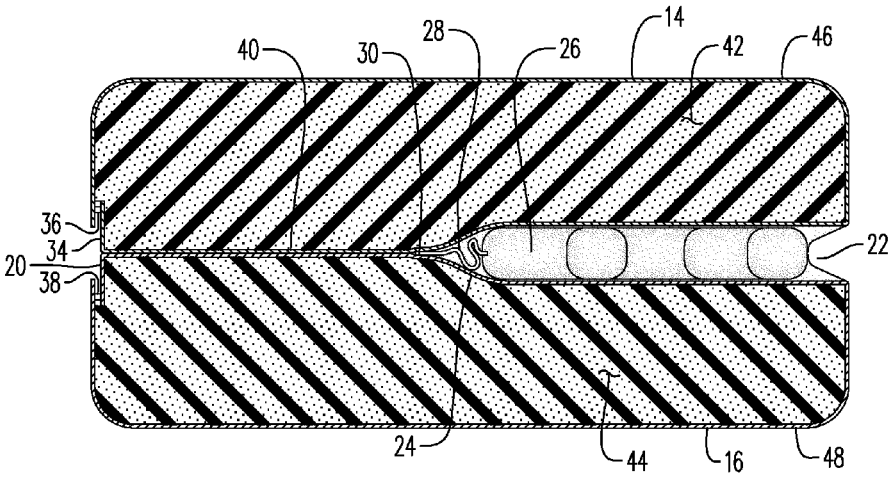
FIG. 6 is a section view in the direction of arrows 6-6 in FIG. 5.

As best seen in FIG. 6, each of the flexible fabric coverings 46 and 48 are held together in side-by-side arrangement against one another along common attached covering panels 40 by sewing or stitching along a common perimeter line 18 and around and defining a pocket 24 except for an unstitched portion which defines a pocket opening 22. The unattached portions of the inner covering panels 40 define the pocket 24 by stitching therealong. This pocket 24 is sized, along with pocket opening 22, to frictionally yet releasably receive a stuffed flexible fabric play item 26 such as a body. The play item 26 is stuffed to a thickness so as to establish the frictional yet releasable size relationship with regard to the thickness of the pocket 24 and, in plan size, so as to be concealable within the pocket 24 as best seen in FIGS. 2 and 5.

Figure 4:
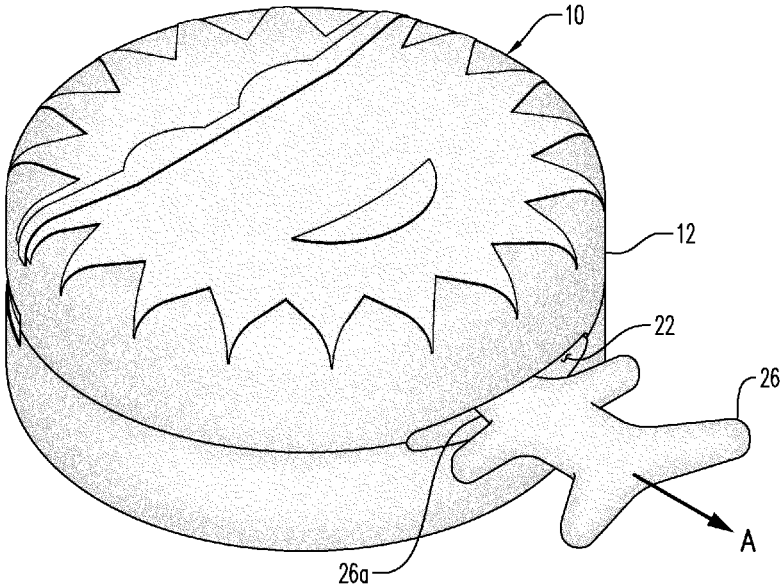
FIG. 4 is a view of FIG. 3 showing the complete withdrawal of the play item in the direction of arrow A ready for play.
Figure 4A:
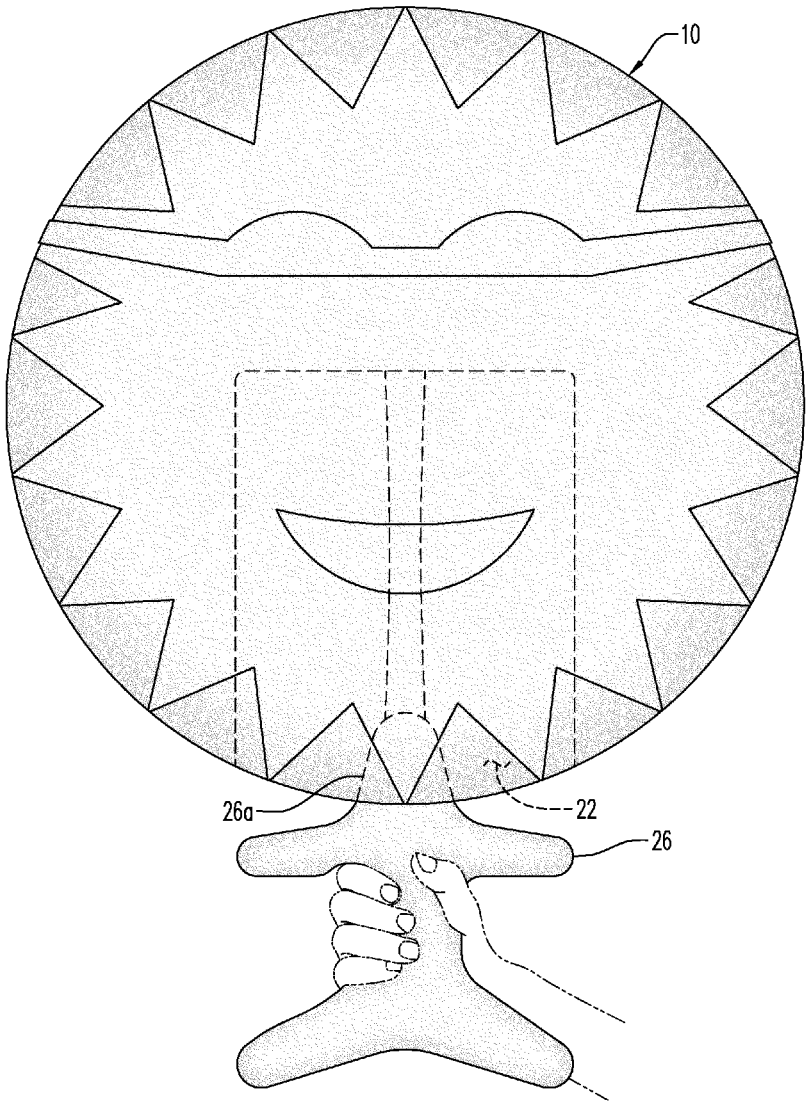
FIG. 4A is a top plan view of FIG. 4.

The play item 26 is attached into the bottom of the pocket 24 by a flexible tether 28 at stitching 30. The other end of the tether 28 is attached to the neck of the doll 26. This arrangement allows a child to withdraw the play item 26 from the pocket 24 through opening 22 in the direction of arrow A in FIG. 3. When completely withdrawn as seen in FIGS. 4 and 4A, the play item 26 may then be played with by the child by hand grasping as shown in FIG. 4A, while the extended tether 28 maintains the neck 26*a* of play item 26 in close, tight proximity to the opening 24 and pillow 12. By this arrangement, the hand-held play item 26 serves as a miniature body for an enlarged head with a face 32 defined by the pillow 12. When play is done, the play item 26 may then be frictionally yet releasably reinserted into the pocket 24 through opening 22, the excess of tether 28 being folded onto itself for storage at the neck 26*a* of the play item 26 as seen in FIG. 6.

Note importantly, that by forming the pocket 24 between the sewn together inner covering panels 40, when the play item 26 is withdrawn, the pocket 26 stays in place.

Figure 6A:
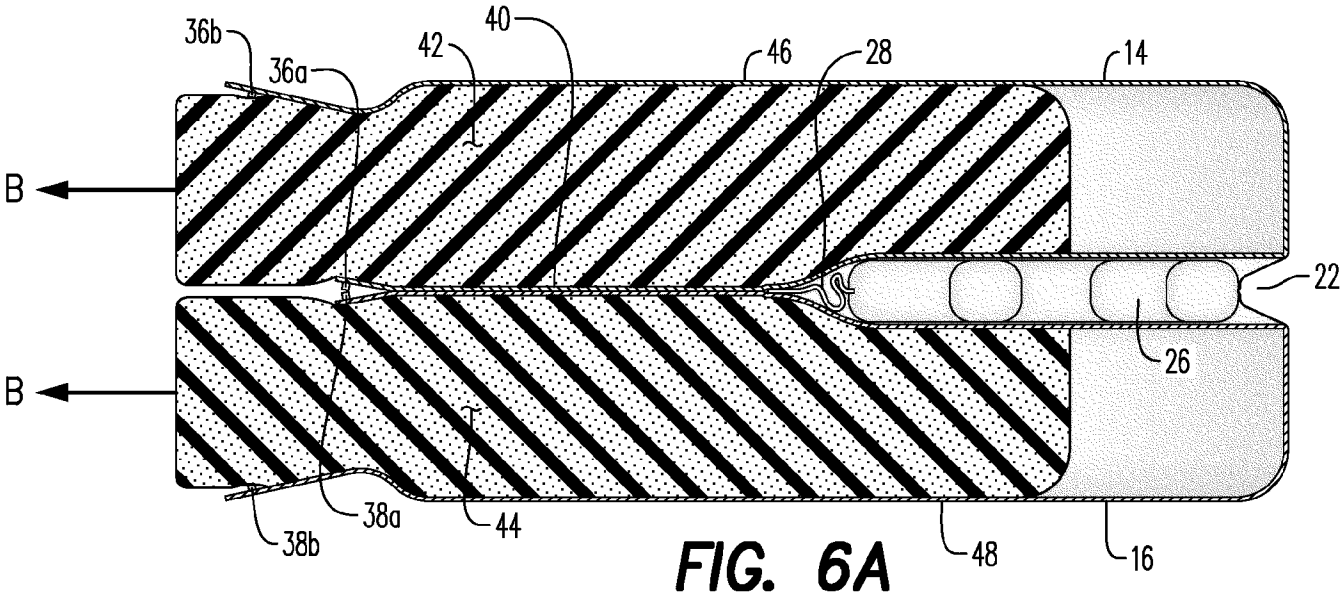
FIG. 6A is a view of FIG. 6 showing the withdrawal of the cushioning medium from within the now opened perimeter edges of the covers.
Figure 7:
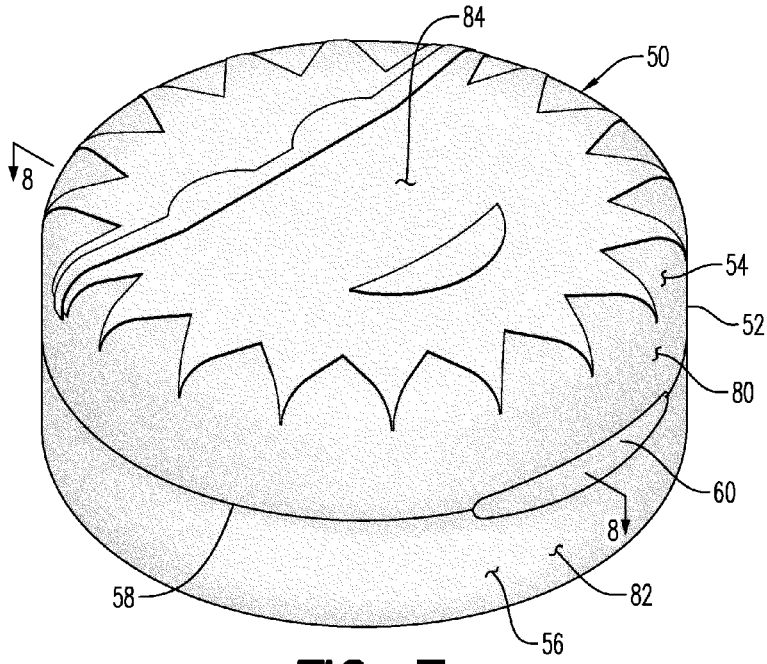
FIG. 7 is a perspective view of another embodiment of the invention.
Figure 8:
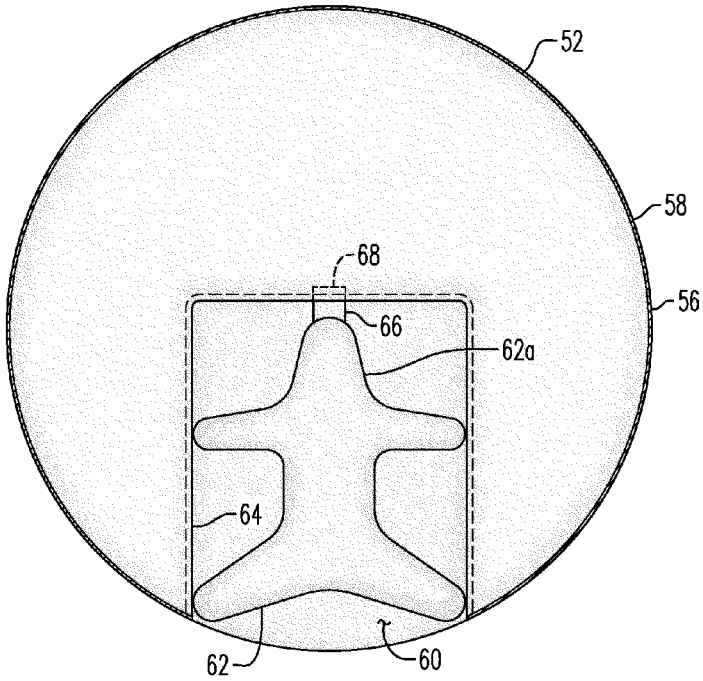
FIG. 8 is a section view in the direction of arrows 8-8 in FIG. 7.
Figure 9:
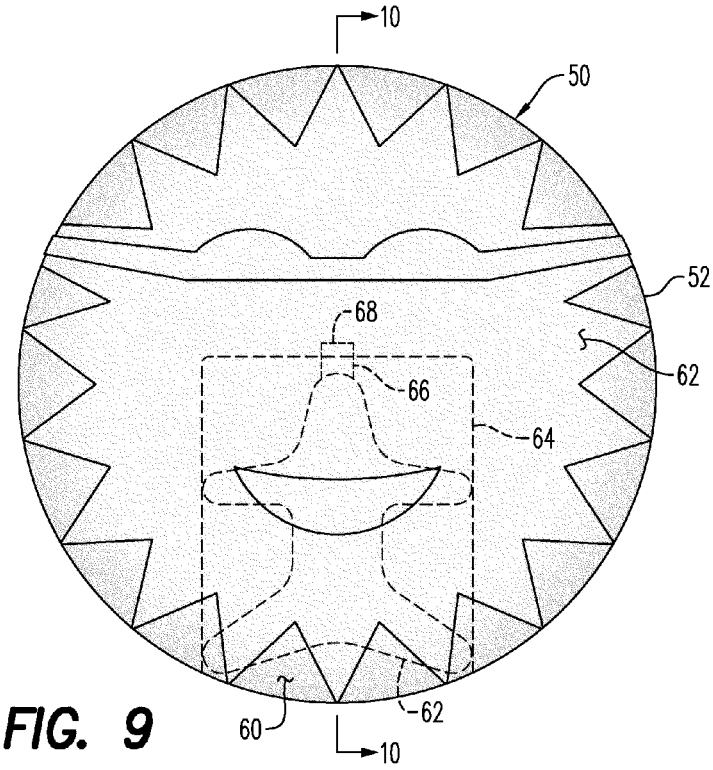
FIG. 9 is a top plan view of FIG. 7.
Figure 10:
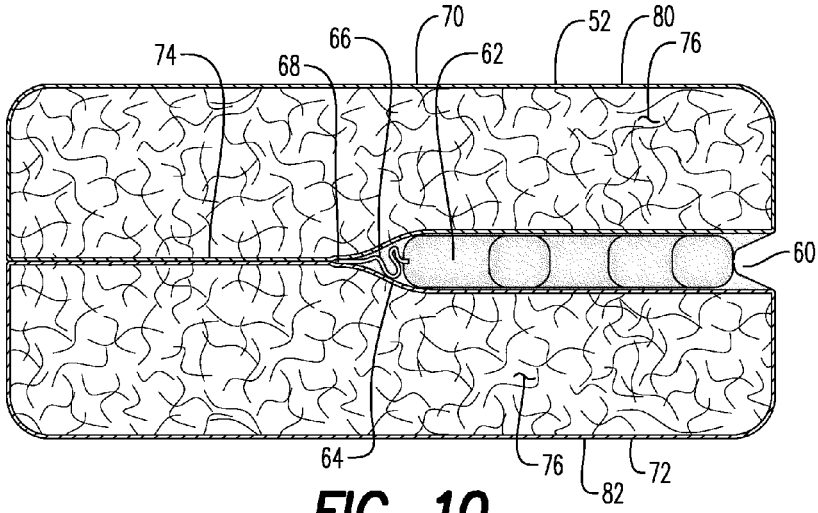
FIG. 10 is a section view in the direction of arrows 10-10 in FIG. 9.

In this embodiment of the fabric coverings 46 and 48, as best seen in FIGS. 6 and 6A, an elongated dual zipper 20 is stitched into place in a suitably prepared opening formed along a portion of the perimeter of each of the fabric coverings 46 and 48 in a well-known fashion. This dual zipper 20 includes spaced parallel zippers 36 and 38 which, when unzipped in the configuration shown in FIG. 6A, permits removal of each of the cushioning mediums 42 and 44 in the direction of arrow B for laundering of the fabric coverings 46 and 48.

Referring now to FIGS. 7 to 10, an alternate embodiment of the invention is there shown generally at numeral 50 and includes a pillow 52 comprised of cushioning members 54 and 56 which are sewn together along the perimeter or common beltline between the inner covering panels 74 in a manner previously described with respect to embodiment 10. Each of the cushioning members 54 and 56 includes a fabric covering 80 and 82, respectively, and a quantity of loose cushioning media 76 in the form of polyfil, 100% loose polyester which is stuffed into each of the fabric coverings 46 and 48 before they are sewn closed and then attached together in side-by-side relationship along the perimeter seam 58.

An unattached portion of the perimeter seam 58 forms the pocket opening 60 as previously described through which the play item 62 is frictionally, yet releasably situated within the pocket 64. A decorative design 78 may be applied along the outwardly facing surfaces of one or both of the fabric coverings 80 and 82 to provide the round shape of the pillow 52 with the appearance of an enlarged head with respect to a miniature body 62.

As previously described, a flexible tether 66 is attached at one end to the play item 62 and, at the other end along stitching 68 to the bottom of the pocket 64 so that the play item 62 may be retracted for play with the neck 62*a* maintained in close, tight proximity to the opening 60 and pillow 52 itself.

Figure 11:
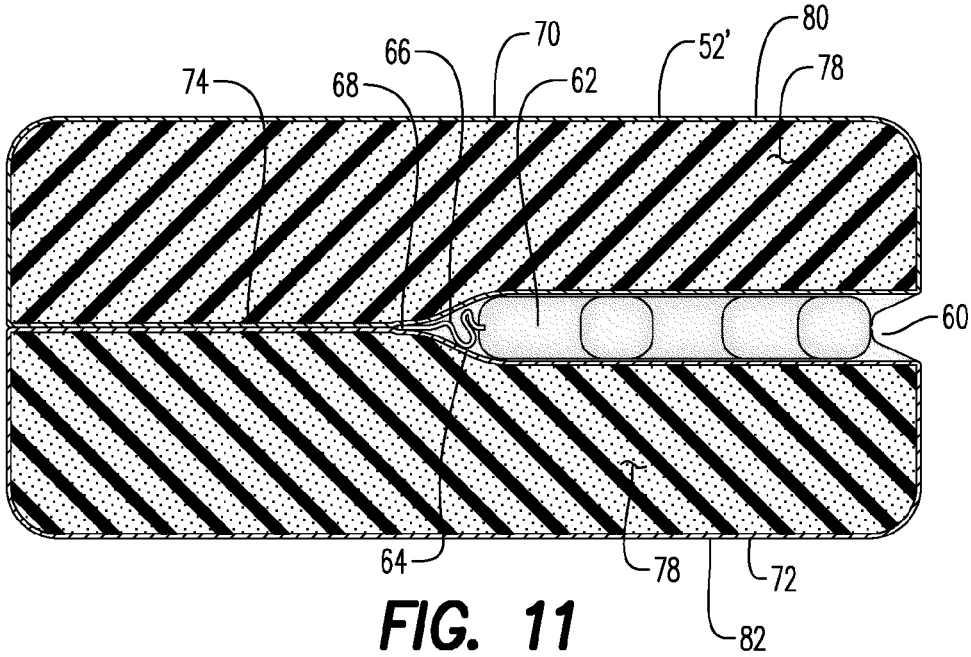
FIG. 11 is a section view similar to FIG. 10 showing an alternate embodiment of cushioning medium stuffed within each of the coverings.
Figure 12:
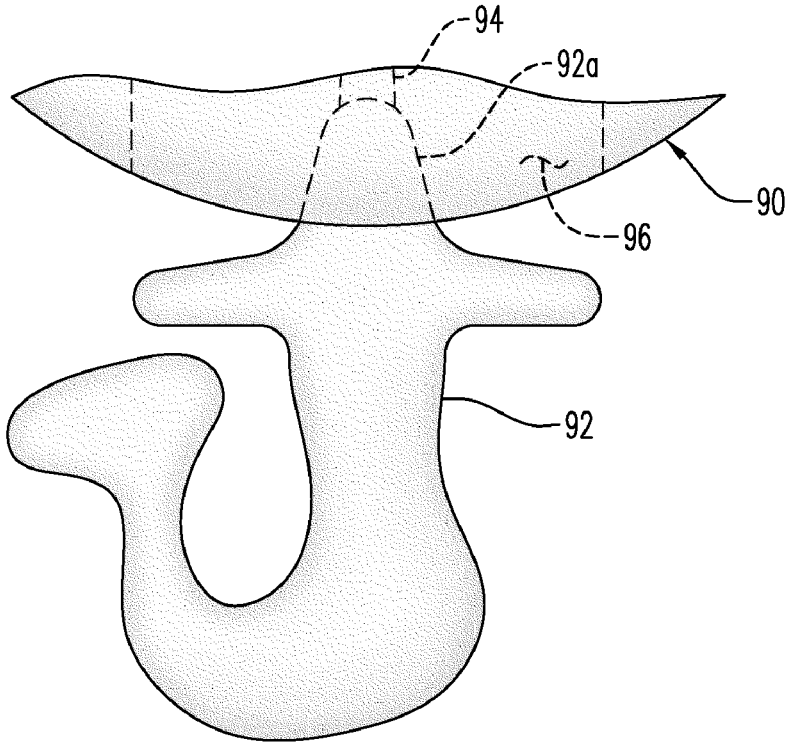
FIG. 12 is a partial plan view of a third embodiment.

Referring now to FIG. 11, the pillow 52' is substantially identical to pillow 52 and all element numberings and descriptions are as previously described except with respect to the foam cushioning medium 76 which is as previously described.

While a number of exemplary aspects and embodiments have been discussed above, those of skill in the art will recognize certain modifications, permutations and additions and subcombinations thereof. It is therefore intended that the following appended claims and claims hereinafter introduced are interpreted to include all such modifications, permutations, additions and subcombinations that are within their true spirit and scope.

The invention claimed is:

1. In combination, a child's pillow and play item concealable within a pocket in the pillow comprising:

two cushioning members each including a cushioning medium and having a flexible fabric covering thereover, the coverings being attached together in a side-by-side arrangement around a common perimeter of the coverings;

an opening formed into the perimeter and defined between an unattached portion of the inner covering panels forming a pocket, the pocket having a bottom;

a play item having a neck of a miniature body and sized to be frictionally yet releasibly situated in the pocket through the opening and to be concealable within the pocket;

an elongated flexible tether connected at one end thereof to the bottom of the pocket, another end of the tether connected to the play item and sized in length to hold the neck of the play item in close proximity to and within the pocket during play.

2. A play pillow as set forth in claim 1, further comprising:

an openable closure extending along a length of the perimeter of each of the covers sized and arranged for removal and replacement of the cushioning members with respect to the covers.

3. A child's stuffed pillow in combination with a play item which is concealable within a pocket comprising:

two disc-shaped cushioning members each including a cushioning medium and having a flexible fabric covering thereover, inner covering panels of the coverings being attached together in a side-by-side arrangement around a common perimeter of the coverings, an outer panel of one covering having a fanciful face design;

an opening formed into the perimeter between an unattached portion of the inner covering panels and extending between the inner covering panels to form a pocket having a bottom;

a stuffed fabric play item having a neck of a miniature body and sized to be frictionally yet releasibly situated in the pocket through the opening, the play item being concealable within the pocket;

an elongated flexible tether connected at one end thereof to the bottom of the pocket, another end of the tether connected to the neck and arranged to hold the play item in close proximity to the pocket during play so that the body, when hand grasped by the child, serves as a handle for the fanciful head;

an openable closure extending along a length of the perimeter between the covers sized and arranged for removal and reinstallation of the cushioning members.

* * * * *